US005394822A

United States Patent [19]

Worland

[11] Patent Number: 5,394,822

[45] Date of Patent: Mar. 7, 1995

[54] UMBRELLA SUPPORT FOR A RECREATIONAL FLOATATION DEVICE

[75] Inventor: Eva J. Worland, Newton, Mass.

[73] Assignee: Aqua-Leisure Industries, Inc., Avon, Mass.

[21] Appl. No.: 106,036

[22] Filed: Aug. 12, 1993

[51] Int. Cl.[6] ..... B63B 7/00

[52] U.S. Cl. ..... 114/345; 114/361

[58] Field of Search ..... 248/511, 528, 529, 539; 135/20.2, 16; 441/35, 40–42, 129–132, 136; 114/345, 361, 352–354, 343; 224/186–190

[56] References Cited

U.S. PATENT DOCUMENTS

| | | | |
|---|---|---|---|
| 65,901 | 6/1867 | Golding | 441/35 |
| 1,746,833 | 2/1930 | Hermansen | 114/343 |
| 1,764,852 | 6/1930 | Phillips | 114/343 |
| 3,034,154 | 5/1962 | Silverstone | 9/11 |
| 3,045,263 | 7/1962 | Blachly | 9/1 |
| 3,656,749 | 4/1972 | Reyes | 273/105 |
| 3,769,647 | 11/1973 | Basa | 9/400 |
| 3,996,868 | 12/1976 | Schagen | 441/74 |
| 4,613,311 | 9/1986 | Wood | 441/130 |
| 4,766,918 | 8/1988 | Odekirk | 114/345 |
| 4,782,777 | 11/1988 | Sussman | 114/345 |
| 4,799,910 | 1/1989 | Kellough | 441/131 |
| 4,828,520 | 5/1989 | Baughman et al. | 441/40 |
| 5,190,194 | 3/1993 | Rosner et al. | 441/131 |
| 5,299,588 | 4/1994 | MacLeod | 441/130 |

*Primary Examiner*—Edwin L. Swinehart
*Attorney, Agent, or Firm*—Wolf, Greenfield & Sacks

[57] ABSTRACT

An umbrella support device. The umbrella support device includes a body having an elongated axis and a flattened configuration. A socket member is secured on the body having an internal bore for receipt of an umbrella handle. An inflation valve and fasteners for removably securing the umbrella support device to a recreational flotation device are also secured on the body.

16 Claims, 3 Drawing Sheets

UMBRELLA SUPPORT FOR A RECREATIONAL FLOATATION DEVICE

BACKGROUND OF THE INVENTION

1. Field of the Invention

The present invention relates to an umbrella support for a recreational floatation device and, more particularly, to an umbrella support for a recreational floatation device for use in a body of water.

2. Description of the Prior Art

Conventional inflatable flotation devices having buoyancy for recreational use in a body of water, such as a swimming pool, include a wide variety of structures, such as chairs, rafts, and ring tubes. Typically, these toys are made of a vinyl plastic material, and are sized and shaped to accommodate one person, typically a child or infant, while floating in a body of water. These devices have developed over the years to provide users with safety and comfort, in particular, for long stays in the water.

For example, a floatation device for aquatic purposes is disclosed by Phillips, in U.S. Pat. No. 1,764,852, and includes a rigid seat situated with a buoyant member. In one embodiment, the Phillips device includes a means to support a sunshade above the user. An aquatic lounge-and-tray ensemble is disclosed by Basa, in U.S. Pat. No. 3,769,647. The Basa device includes a rigidly interconnected floating means to support the user, a tray means, a paddle means, and a shade or canopy means. Similarly, an aquatic floatation device ensemble is disclosed by Kellough, in U.S. Pat. No. 4,799,910. The Kellough device, directed to infant use, includes a circular foamed plastic float, a fabric seat, and an attached frame collapsible canopy for protecting an infant from direct exposure of the sun's rays.

Although providing a wide variety of floatation devices for many different applications, none of the foregoing, or similar devices, provide a detachable umbrella support device for a variety of recreational floatation devices.

It is therefore an object of this invention to provide an umbrella support device, which can be easily attached to an inflatable recreational floatation device.

A further object of this invention is to provide an umbrella support device that firmly supports an umbrella, or other sunshade device, providing added safety and comfort for a user by shielding the sun's rays.

SUMMARY OF THE INVENTION

Accordingly, the present invention provides an umbrella support for a recreational floatation device. The umbrella support for a recreational floatation device includes a body having an elongated axis. A means for attaching an umbrella handle is secured along the axis of the body. Lastly, means for attaching the umbrella support to a recreational floatation device is provided on the umbrella support device.

In a preferred embodiment of the present invention, the umbrella support for a recreational floatation device includes an inflatable body having an elongated axis and a flattened configuration. A socket member is secured along the axis of the body which has an internal bore for slidable receipt of an umbrella handle. An inflation valve is also secured on the body for inflating the umbrella support device body. Means for attaching the umbrella support to a recreational floatation device is provided on the umbrella support device.

In another embodiment of the present invention the umbrella support for a recreational floatation device includes a body having an elongated axis constructed of a foamed plastic material. A socket member is secured along the axis of the body having an internal bore for slidable receipt of an umbrella handle. And lastly, means for attaching the umbrella support to a recreational floatation device is provided.

In an alternative embodiment, the umbrella support for a recreational floatation device can have a unitary construction of a foamed plastic material. The umbrella support device includes a body having an elongated axis, a socket portion positioned along the axis having an internal bore for slidable receipt of an umbrella handle, and means for attaching the umbrella support to a recreational floatation device.

The present invention is also directed to a recreational floatation device including an inflatable main body having an elongated horizontal axis and a flattened configuration. The recreational floatation device also includes at least one umbrella support device preferably having an inflatable body, an elongated axis and a flattened configuration. The umbrella support device, as described above, also preferably includes a socket member secured on the umbrella support body having an internal bore for slidable receipt of an umbrella handle, an inflation valve secured on the umbrella support body, and means for attaching the umbrella support to the recreational floatation device. The umbrella support device of the present invention can be attached to floatation devices having a wide variety of shapes and designs. The recreational floatation device can have a circular body with a symmetrical opening in the middle thereof for child access. The recreational floatation device can have a supporting seat means secured to the circular body including a pair of spaced leg openings, through which a child's legs may extend when the child is seated in the floatation device.

BRIEF DESCRIPTION OF THE DRAWINGS

The foregoing and other objects and advantages of the invention will be appreciated more fully from the following drawings in which.

DETAILED DESCRIPTION OF THE INVENTION

Figure 1:
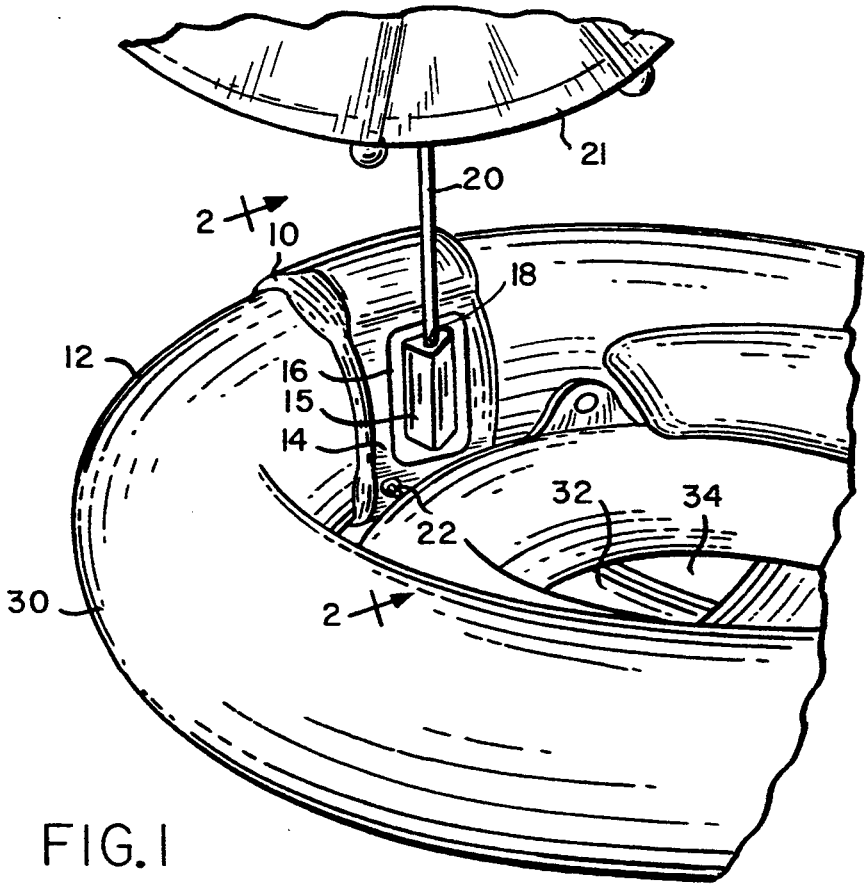
FIG. 1 is a perspective view of an umbrella support device of the present invention attached to a recreational floatation device.

The present invention is directed to an umbrella support for a recreational floatation device including a body having an elongated axis. A means for attaching an umbrella handle is secured along the axis of the body. Lastly, means for attaching the umbrella support to a recreational floatation device is provided on the umbrella support device.

Turning now to the Figures, wherein like reference numerals indicate like elements, FIGS. 1–5 represent one embodiment of an umbrella support device 10 of the present invention.

FIG. 1 is a perspective view of umbrella support device 10 attached to a recreational floatation device 12. Device 10 includes an inflatable body 14 which has an elongated axis and a flattened configuration. A socket member 15 is secured to body 14 by socket member base portion 16. The socket member 15 has an internal bore 18 for slidable receipt of an umbrella handle 20 which is typically supporting an umbrella sunshade portion 21. A conventional inflation valve 22 is also secured on body 14 for inflating device 10.

Figure 2:
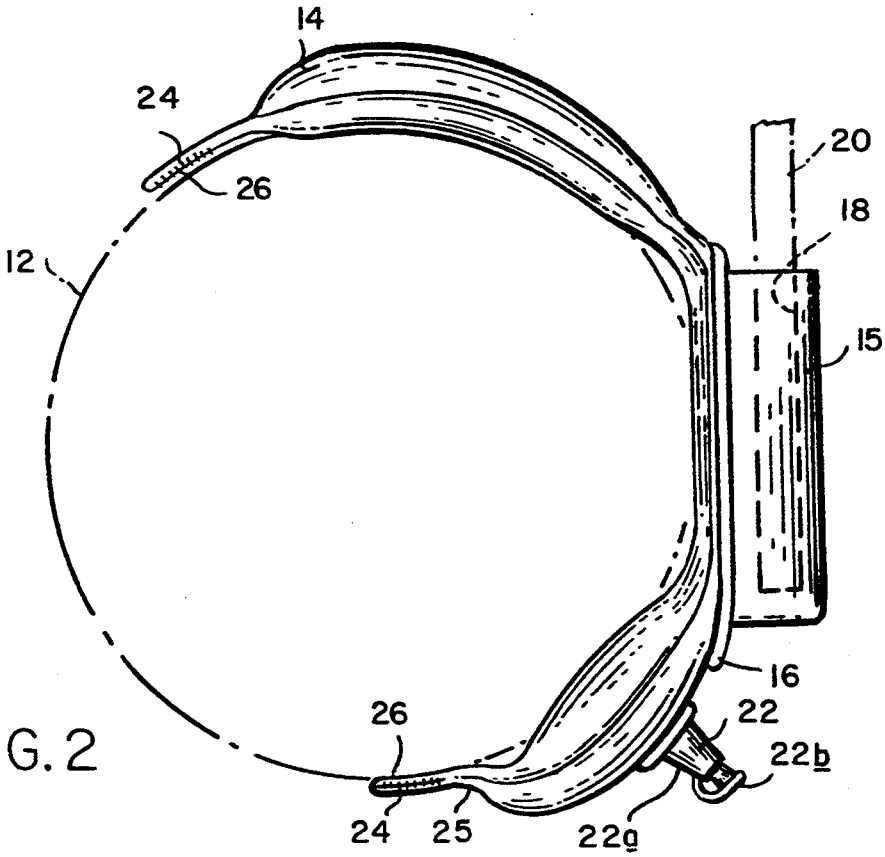
FIG. 2 is a cross-sectional side view of the umbrella support device for a recreational floatation device of the present invention, taken along line 2—2 of FIG. 1.

FIG. 2 shows a cross-sectional side view of the umbrella support device 10 taken along line 2—2 of FIG. 1. The cross-section shows means for attaching the umbrella support device 10 to the recreational floatation device 12 can be a synthetic material which adheres when pressed together. One such material is VELCRO® hook and loop fastener (trademark of VELCRO USA, Manchester, N.H.), including male portions 24 attached to tabs 25 extending beyond body 14 of umbrella support device 10. Male portions 24 can be removably joined with female portions 26 which are attached by methods known to those skilled in the art, such as adhesive bonding, to the recreational floatation device 12. In another embodiment (not shown) a male portion of a hook and loop-type fastener can be attached to one tab and a female portion can be attached to the opposite tab. The two tab portions can then be removably joined to each other while the umbrella support device body surrounds a portion of the recreational floatation device.

Referring again to FIG. 1, umbrella support device 10 is shown attached to a recreational floatation device 12 having an inflatable circular body 30 and a symmetrical opening in the middle thereof for child access. A supporting seat means 32 can be provided and secured to circular body 30. The supporting seat means 32 typically includes a pair of spaced leg openings 34 through which a child's legs may extend when the child is seated in the recreational floatation device 12. The circular body 30 and supporting seat means 32, when inflated, has a buoyancy in water sufficient to support a child. When attached to such a recreational floatation device for small children, umbrella support device 10 provides added safety and comfort needed for a young child or infant, namely, by shielding the sun's harmful rays from the delicate skin of small children or infants.

Figure 3:
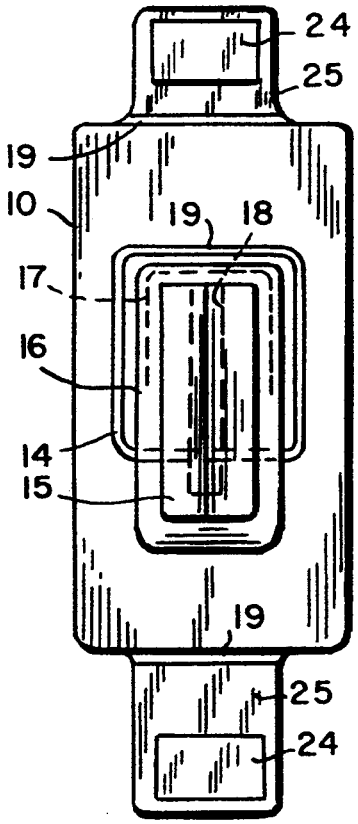
FIG. 3 is a front view of the umbrella support device as shown in FIG. 2.
Figure 4:
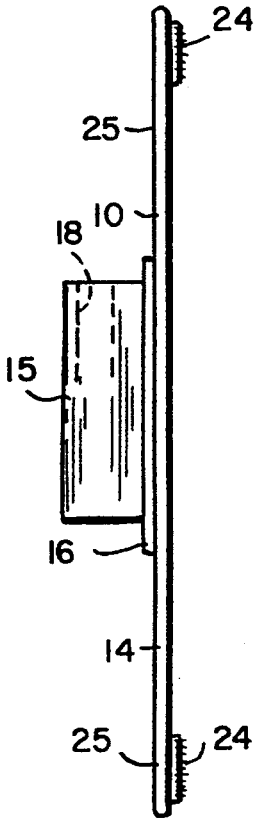
FIG. 4 is a side view of the umbrella support device as shown in FIG. 2.
Figure 5:
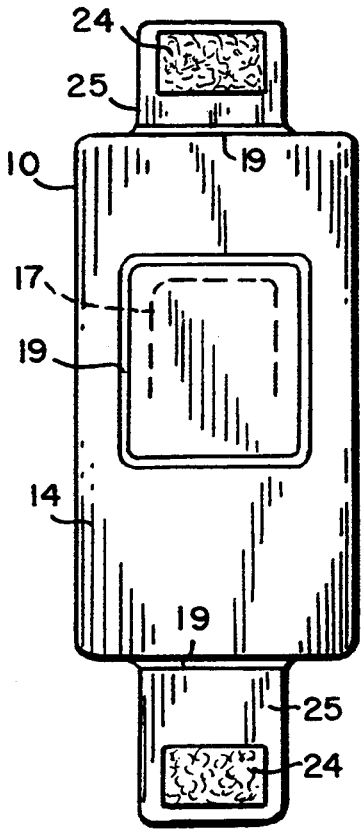
FIG. 5 is a rear view of the umbrella support device as shown in FIG. 2.

Umbrella support device body 14 is typically constructed of a material similar to that of recreational floatation device 12. As is known to those skilled in the art, recreational floatation devices are typically made of a soft, flexible, resilient material which is relatively inexpensive while providing satisfactory weathering and sunlight resistance, as well as good sealing and mechanical properties. Body 14, and recreational floatation device 12, should be made of a material that is chemically resistant to swimming pool chemicals, such as chlorine, as well as salt water. Preferably, body 14 is constructed of a vinyl plastic material, which addresses the above preferred characteristics. Preferably, body 14 is constructed of polyvinyl chloride, due to its relative inexpensive cost and availability, as well as its advantageous physical properties. It is noted, however, that other materials known to those of skill in the art could be used to form body 14. For example, polyethylene, polypropylene, nylon, latex, neoprene rubber, and the like; a chlorosulphonated polyethylene, such as HYPOLON TM synthetic rubber material (trademark of E. I. DuPont de Nemours Co., Wilmington, Del.) could be processed to provide the above-noted characteristics of body 14. Typically, plastics or rubber additives, such as stabilizers, anti-oxidants, and plasticizers, are added to the main component material (preferably, polyvinyl chloride) to maintain or enhance softness and pliability, as well as to provide resistances to weathering, chemicals, and/or mildew. Furthermore, other additives are used to provide additional strength and/or color to the main component material. These additives are all well known to those skilled in the art; plasticizers, for example, include polyols such as ethylene glycol and its derivatives. After the desired additives are mixed into the main component material, body 14 is formed by processes known to those skilled in the art, such as calendaring, casting, extruding, or molding. Body 14 may be formed, for example, by heat sealing an upper and lower portion which are similarly shaped, around the outer peripheries. FIGS. 3, 4 and 5 show front, side, and rear views of device 10, including heat seals 19 formed around the outer periphery, as well as within body 14. Heat seals 19 prevent the inflation gas from inflating tab portions 25, as well as the body's center portion. Because these areas do not include inflation gas the means for attaching, such as the male portion 24 of a VELCRO® fastening strip material, and the socket member base portion 16 can be attached to the umbrella support device by means such as stitching 17, heat sealing, adhesive bonding and the like. Typically, the material of construction of the inflatable body 14 has a thickness of between about 5 and about 25 gauge, and preferably between about 5 and about 15 gauge. It has been found that thicknesses within this range provide adequate strength while allowing body 14 to be easily inflated. Most preferably, the body material has a thickness of at least about 12 gauge.

Umbrella support device 10 includes a socket member 15 secured along the axis of body 14. As noted above, socket member 15 can be secured to body 14 by means known to those skilled in the art, such as with stitching, heat sealing, adhesive bonding, and the like. Typically, socket member 15 includes a base portion 16 which provides a larger surface area to contact body 14 surface, thereby providing a more secure and rigid attachment. Socket member 15 is typically constructed of a semi-rigid material, preferably a lightweight plastic material such as high-density polyethylene, polypropylene, polyvinyl chloride, nylon, and the like. Socket member base portion 16 can be constructed of a different more flexible material, or a thinner gauge of the material used to make the socket member to conform to the umbrella support device body 14 when inflated. Socket member 15 has an internal bore 18 for slidable receipt of an umbrella handle 20 (as shown in FIGS. 1 and 2). Bore 18 typically has an internal diameter and length which are adequate to securely support an umbrella or other sunscreen device. Preferably, bore 18 has an internal diameter of between about 0.25 inch and about 1.5 inches. Most preferably, the internal diameter of the bore is about 0.5 inch. The length of the bore is preferably between about 2.0 inches and about 6.0 inches, and most preferably, between about 3.0 inches and 5.0 inches.

It is noted, however, that the socket member's internal bore 18 can have any cross-sectional shape, internal diameter and length to secure a sunshade device handle 20. Typically, umbrella handle 20 has a secure friction fit within bore 18. In another embodiment (not shown) a set screw, or pin, can be provided on the socket member 15 to further support handle 20 within bore 18. Furthermore, it is preferable that internal bore 18 and umbrella handle 20 have complimentary cross-sectional configurations such that handle 20 is coaxially slidable through bore 18. It is further noted that a reducing fitting (not shown) may be inserted into bore 18 to provide a more secure fit between umbrella handle 20 and bore 18. This type of fitting may also be useful to conform the cross-sectional shape of bore 18 to that of the umbrella handle.

It is noted that while socket member 15 is shown and described, alternative means known to those skilled in the art, such as clips, snaps, tapes, and other fastening devices, can be used to support umbrella handle 20. These devices can be secured to body 14 as noted above. The alternative attachment devices can be secured to body 14 by stitching, heat sealing, adhesive bonding, and the like. A base portion 16 can also be provided with an alternative attachment device.

Umbrella support device 10 also includes an inflation valve 22 secured on body 14 for inflating device 10. Valve 22 (shown in FIGS. 1 and 2) can be any standard inflation valve, commercially available and known to those of skill in the art. Preferably, valve 22 is a self-sealing, or one-way valve commonly known as a safety valve, which allows air flow into body 14. A forceful stream of air, from a foot pump, hand pump, compressed air container or the like, can be introduced into body 14 through valve 22. When the body 14 is inflated by mouth, however, valve cylinder **22*a* is first pinched as air pressure from the lungs is usually insufficient to force open the check flap portion of a typical safety valve. Air will not flow into or out of body 14 when valve 22 is in the closed position. Once body 14 is fully inflated, cap 22*b* is placed onto valve cylinder 22*a*. For further security, the entire valve 22 can then be pushed into the surface of body 14. It is noted that other types of one-way or traditional inflation valves can be used with device 10 and secured to body 14. Valve 22 can be secured to body 14**, for example, with an adhesive, a heat seal, or other methods known to those skilled in the art.

Figure 6:
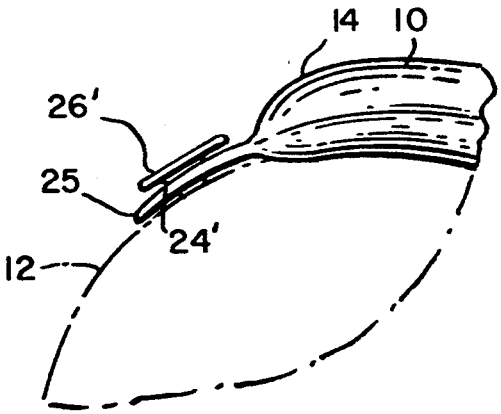
FIG. 6 shows an alternative means for attaching the umbrella support device to a recreational floatation device.
Figure 7:
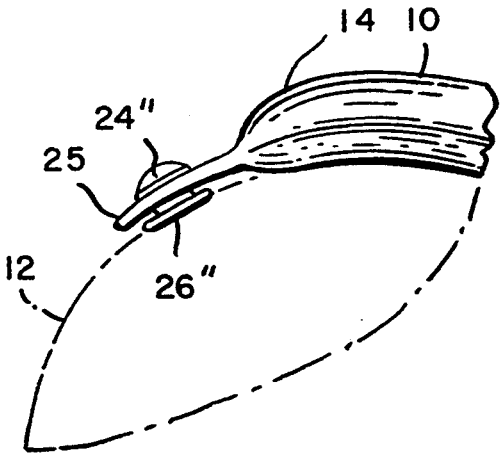
FIG. 7 shows an alternative means for attaching the umbrella support device to a recreational floatation device.

Referring now to FIGS. 6 and 7, alternative means for attaching the umbrella support device 10 to a recreational floatation device 12 are shown. While a synthetic material which adheres when pressed together, such as a VELCRO ® hook and loop fastener material, is advantageous in that it allows for a multiplicity of tightnesses and can be easily joined together and separated, other means can be provided which are easy to use, and relatively inexpensive to incorporate onto umbrella support device 10. FIG. 6 shows the means for attaching umbrella support device 10 to a recreational floatation device 12 as a button-type fastener. A button slit 25' is provided on the non-inflated tab portion 25 portion of device 10. The tab portion 25 is not inflated due to heat seal (19 in FIGS. 3 and 5) around the periphery of body 14, as described above. Button 26', attached to recreational floatation device 12 by methods known to those skilled in the art, can be fitted through slit 24' to secure device 10. FIG. 7 similarly shows an alternative means for attaching device 10 to recreational floatation device 12 using a snap-type fastener. In this embodiment, the female portion 24'' of a conventional snap-type fastener is secured to tab portion 25. Male portion 26'' of the snap-type fastener can be secured to the recreational floatation device by methods known to those of skill in the art. It is noted that other means for attaching the umbrella support device to a recreational floatation device can be used as would be known and appreciated by those having skill in the art. It is noted also that various combinations of the same or different means for attaching the umbrella support device can be used to provide a multiplicity of tightnesses and firmness, addressing the overall objective of supporting an umbrella or sunshade above the user of the recreational floatation device.

In an alternative embodiment of the present invention, body 14 can be formed of a lightweight, non-deflatable material that has excellent buoyancy characteristics such as a foamed plastic material, typically polystyrene or the like. A socket member is secured along the axis of the body having an internal bore for slidable receipt of an umbrella handle, as described above. Means for attaching the umbrella support device to a recreational floatation device can be provided as noted above.

In still other alternative embodiments of the invention (not shown) the umbrella support device for a recreational floatation device is a one piece, or unitary, construction. The device includes a body having an elongated axis, a socket portion positioned along the axis having an internal bore for slidable receipt of an umbrella handle, and means for attaching the umbrella support to a recreational floatation device. In this embodiment, the umbrella support device is also constructed of a foamed plastic material, such as polystyrene, to provide adequate support for an umbrella or other sunshade device.

Figure 8:
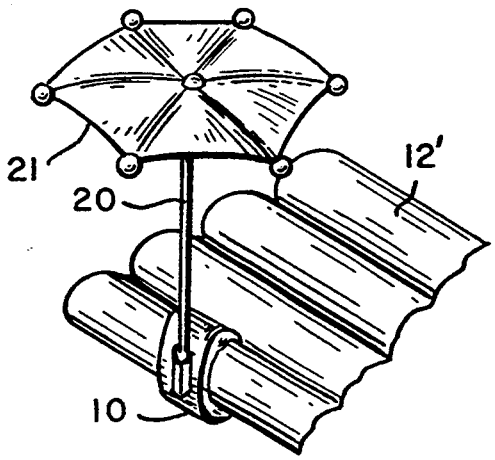
FIG. 8 is a recreational floatation device having an umbrella support device attached thereto, supporting an umbrella.
Figure 9:
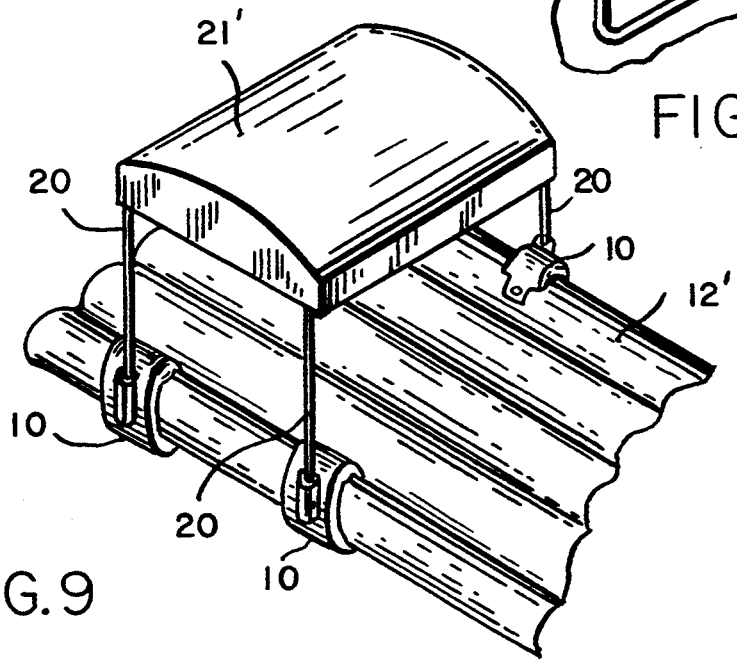
FIG. 9 is a recreational floatation device having a plurality of umbrella support devices attached thereto, supporting a canopy.

Referring now to FIGS. 8 and 9, various applications of the umbrella support device 10 of the present invention are shown. FIG. 8 shows umbrella support device 10 attached to the side portion of a recreational floatation device 12' in a raft-type configuration. Umbrella handle 20 supporting sunshade portion 21 of the umbrella is secured in the socket member's internal bore 18 of the umbrella support device as described above. This application of the umbrella support device 10 of the present invention illustrates that it can be used with a variety of recreational floatation devices to provide adults, as well as children, with protection from the harmful effects of exposure to the sun's rays over an extended period of time.

FIG. 9 shows that a plurality of umbrella support devices 10 of the present invention can be attached to a recreational floatation device 12', such as a raft, to support an alternative sunshade device such as a canopy 21'. It is noted that the umbrella support device of the present invention may also be used to support other items on a recreational floatation device, such as a tray for supporting food, beverages, and the like (not shown).

Figure 10:
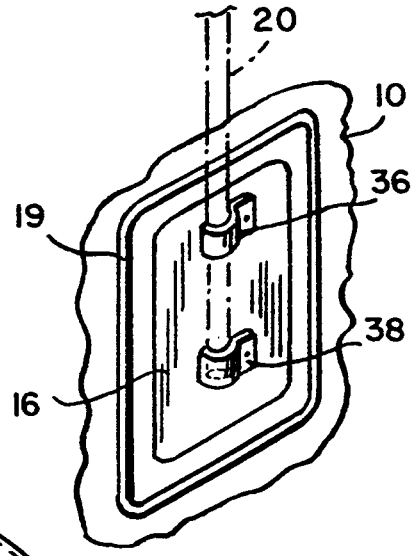
FIG. 10 shows an alternative means for attaching the umbrella handle to the umbrella support device.

FIG. 10 shows an alternative means for attaching umbrella handle 20 to umbrella support device 10. As noted above, other means can be secured to body 1& to support umbrella handle 20. FIG. 10 shows clips 36, 38 attached to base portion 16 by methods known to those skilled in the art; portion 16 is attached to umbrella support device 10 by heat seal 19. Clips 36, 38 can be made of any semi-rigid material, preferably a lightweight plastic material such as high-density polyethylene, polypropylene, polyvinyl chloride, nylon, and the like. Base portion 16 can be constructed of a different, more flexible material, or a material similar to clips 36, 38. Clips 36, 38, or any other means for securing umbrella handle 20 to device 10, known to those skilled in the art, can be formed in any size and shape provided that umbrella handle 20 is firmly supported in an upright position while device 10 is attached to a recreational floatation device.

The present invention will be further illustrated by the following example, which is intended to be illustrative in nature and is not to be construed as limiting the scope of the invention.

EXAMPLE

One suitable construction of an umbrella support for a recreational floatation device having a shape and design substantially in accordance with the present invention is provided by the following combination of elements.

An umbrella support device is provided, as shown in FIGS. 3, 4 and 5 utilizing a button-type fastener as shown in FIG. 6. The device includes an inflatable body constructed of 12 gauge thickness polyvinyl chloride. The device has an overall length of 16.0 inches and an overall width of 4.75 inches. The device has an inflatable body portion that is approximately 10.0 inches in length having an elongated vertical axis and a flattened configuration. An upper and lower tab are formed as the body is heat sealed along its outer periphery. The upper tab and lower tab have widths of about 2.75 inches, while the upper tab length is about 2.25 inches and the lower tab length is about 3.75 inches. Approximately 0.50 inch from the outer edge of both the upper and lower tabs is a 1.0 inch wide slit, or eyelet, which is centered in the tab. Each slit is surrounded by a heat seal, which is approximately 0.75 inch$\times$1.75 inch. A 3.0 inch square heat seal is provided in the body of the umbrella support device. The upper portion of the heat seal is approximately 2.5 inches from the upper heat seal of the body (defining the base of the upper tab portion) and is centered between each side. A socket member base portion is stitched onto the non-inflated body portion formed by the central 3.0 inch square heat seal, while the lower edge of the socket member base portion is heat sealed to the surface of the inflatable body of the device. The socket member base portion is approximately 2.375 inches wide and 5.0 inches in length. The socket member has a centered protruding portion on its base of approximately 1.50 inch width, 4.0 inches in length, and 1.0 inch in height. The socket member includes a 0.375 inch internal diameter bore having a length of about 4.0 inches. A 0.125 inch diameter hole is included in the base of the bore for drainage purposes. A commercially available inflation valve is secured by heat seal to the body, below the socket member. The umbrella support device is inflated and secured to a recreational floatation device including two buttons which are heat sealed, approximately 10.0 inches apart, to the body of the recreational floatation device. The umbrella support device is attached to the recreational floatation device by inserting the button portion through the slits provided in the upper and lower tab portions of the umbrella support device. Once in place, an umbrella having a handle with an outside diameter of about 0.25 inch and a length of about 20.0 inches is inserted into the socket member's internal bore. The umbrella is thus positioned substantially perpendicular to the surface of the recreational floatation device.

Although particular embodiments of the invention have been described in detail for purposes of illustration, various modifications may be made without departing from the spirit and scope of the invention. Accordingly, the invention is not to be limited except as by the appended claims.

What is claimed is:

1. An umbrella support device, comprising:

an inflatable body having an elongated axis and a flattened configuration;

a socket member secured along said axis, said member having an internal bore for receipt of an umbrella handle;

an inflation valve secured on said body for inflating and deflating said body; and means for removably securing said umbrella support device to a recreational floatation device.

2. The umbrella support of claim 1 wherein said body is constructed of a soft, flexible, resilient material.

3. The umbrella support of claim 2 wherein said material is polyvinyl chloride.

4. The umbrella support of claim 2 wherein said material has a thickness of between about 5 and about 15 gauge.

5. The umbrella support of claim 4 wherein said material has a thickness of about 12 gauge.

6. The umbrella support of claim 1 wherein said socket member is constructed of a semi-rigid material.

7. The umbrella support of claim 1 wherein said internal bore and said umbrella handle have complementary cross-sectional configurations such that said handle is coaxially slidable through said bore.

8. The umbrella support of claim 1 wherein said means for removably securing said umbrella support device to said recreational floatation device is a hook and loop fastener.

9. The umbrella support of claim 1 wherein said means for removably securing said umbrella support device to said recreational floatation device is a button fastener.

10. The umbrella support of claim 1 wherein said means for removably securing said umbrella support to said recreational floatation device is a snap fastener.

11. An umbrella support device, comprising:

a body having an elongated axis;

a socket member secured along said axis, said member having an internal bore for receipt of an umbrella handle; and means for removably securing said umbrella support device to a recreational floatation device.

12. The umbrella support of claim 11 wherein said body is constructed of a foamed plastic material.

13. The umbrella support of claim 11 wherein said socket member is constructed of a semi-rigid material.

14. The umbrella support of claim 11 wherein said internal bore and said umbrella handle have complementary cross-sectional configurations such that said handle is coaxially slidable through said bore.

15. A recreational floatation device, comprising:

an inflatable main body having an elongated horizontal axis and a flattened configuration;

said main body, when inflated, having a buoyancy in water sufficient to support a user; and at least one inflatable umbrella support device, a socket member secured on said umbrella support device, said member having an internal bore for receipt of an umbrella handle, an inflation valve secured on said umbrella support device for inflating and deflating said device, and means for removably securing said umbrella support device to said recreational floatation device.

16. A recreational floatation device, comprising:

an inflatable circular body having a symmetrical opening in the middle thereof for child access;

a supporting seat means secured to said circular body, said supporting seat means including a pair of spaced leg openings through which a child's legs may extend when the child is seated in said floatation device, said circular body, when inflated, having a buoyancy in water sufficient to support a child; and at least one umbrella support device having an inflatable body, an elongated axis and a flattened configuration, a socket member secured on said umbrella support body, said member having an internal bore for slidable receipt of an umbrella handle, an inflation valve secured on said umbrella support body for inflating said body, and means for attaching said umbrella support to said recreational floatation device.

* * * * *